US009327175B2

(12) United States Patent
Pressley

(10) Patent No.: US 9,327,175 B2
(45) Date of Patent: May 3, 2016

(54) BATTING TRAINING DEVICE FOR TEACHING A BATTER TO BAT AT A LEVEL SWING PLANE

(71) Applicant: David Pressley, Pendleton, IN (US)

(72) Inventor: David Pressley, Pendleton, IN (US)

( * ) Notice: Subject to any disclaimer, the term of this patent is extended or adjusted under 35 U.S.C. 154(b) by 0 days.

(21) Appl. No.: 14/538,546

(22) Filed: Nov. 11, 2014

(65) Prior Publication Data

US 2015/0133242 A1 May 14, 2015

Related U.S. Application Data

(60) Provisional application No. 61/902,828, filed on Nov. 12, 2013.

(51) Int. Cl.

| | |
|---|---|
| ***A63B 69/00*** | (2006.01) |
| *A63B 69/36* | (2006.01) |
| *A63B 71/02* | (2006.01) |

(52) U.S. Cl.

CPC ..... *A63B 69/0002* (2013.01); *A63B 69/0079* (2013.01); *A63B 69/3641* (2013.01); *A63B 2069/0008* (2013.01); *A63B 2071/026* (2013.01); *A63B 2225/093* (2013.01)

(58) Field of Classification Search

CPC .... A63B 63/003; A63B 63/06; A63B 69/002; A63B 69/0024; A63B 69/34; A63B 69/0079; A63B 21/04; A63B 69/0002; A63B 69/0075; A63B 69/0057

USPC ..... 473/422, 451, 453, 423, 417

See application file for complete search history.

(56) References Cited

U.S. PATENT DOCUMENTS

| | | | | |
|---|---|---|---|---|
| 4,451,036 | A * | 5/1984 | Sinclair | A63B 69/0002 473/453 |
| 4,886,267 | A | 12/1989 | Licciardi et al. | |
| 5,087,039 | A | 2/1992 | Laseke | |
| 5,098,094 | A * | 3/1992 | Kita | A63B 69/0079 473/423 |
| 5,322,276 | A | 6/1994 | Hardison, Jr. | |
| 5,711,726 | A * | 1/1998 | Powers | A63B 69/0002 473/453 |
| 5,779,568 | A * | 7/1998 | Turner | A63B 24/0003 473/423 |
| 5,842,938 | A * | 12/1998 | Garber | A63B 43/007 473/418 |
| 6,190,176 | B1 * | 2/2001 | Turner | A63B 69/0079 473/430 |
| 6,878,077 | B2 | 4/2005 | Andrews | |
| 7,115,051 | B2 * | 10/2006 | Hansberry | A63B 69/0002 473/422 |
| 7,131,916 | B2 | 11/2006 | Griffin | |
| 7,662,052 | B1 * | 2/2010 | Vidrine | A63B 69/0002 473/417 |
| 7,955,196 | B2 * | 6/2011 | Constant | A63B 69/0002 473/422 |
| 8,113,968 | B2 * | 2/2012 | Fittler | A63B 63/003 473/422 |
| 9,061,190 | B2 * | 6/2015 | Willardson | A63B 69/0002 473/453 |
| 2003/0220177 | A1 * | 11/2003 | Orlando | A63B 21/04 482/148 |
| 2006/0089212 | A1 * | 4/2006 | Marchel | A63B 21/026 473/422 |
| 2006/0148597 | A1 * | 7/2006 | Pope | A63B 69/0002 473/453 |
| 2006/0240917 | A1 * | 10/2006 | Campbell | A63B 69/0002 473/453 |
| 2007/0129182 | A1 * | 6/2007 | Taylor | A63B 69/0057 473/422 |
| 2008/0248900 | A1 | 10/2008 | Hernandez | |

* cited by examiner

*Primary Examiner* — Mitra Aryanpour
(74) *Attorney, Agent, or Firm* — Ritchison Law Offices, PC; John D Ritchison

(57) ABSTRACT

A baseball training device for batting with a level swing called a Swing Plane. It relates to a product that is developed as a training device for a large number of swing repetitions in order to create muscle memory. The device is built with a frame having a spreader base, vertical telescoping members and a top structure for hanging flexible cords and a baseball.

3 Claims, 10 Drawing Sheets

Figure 2:
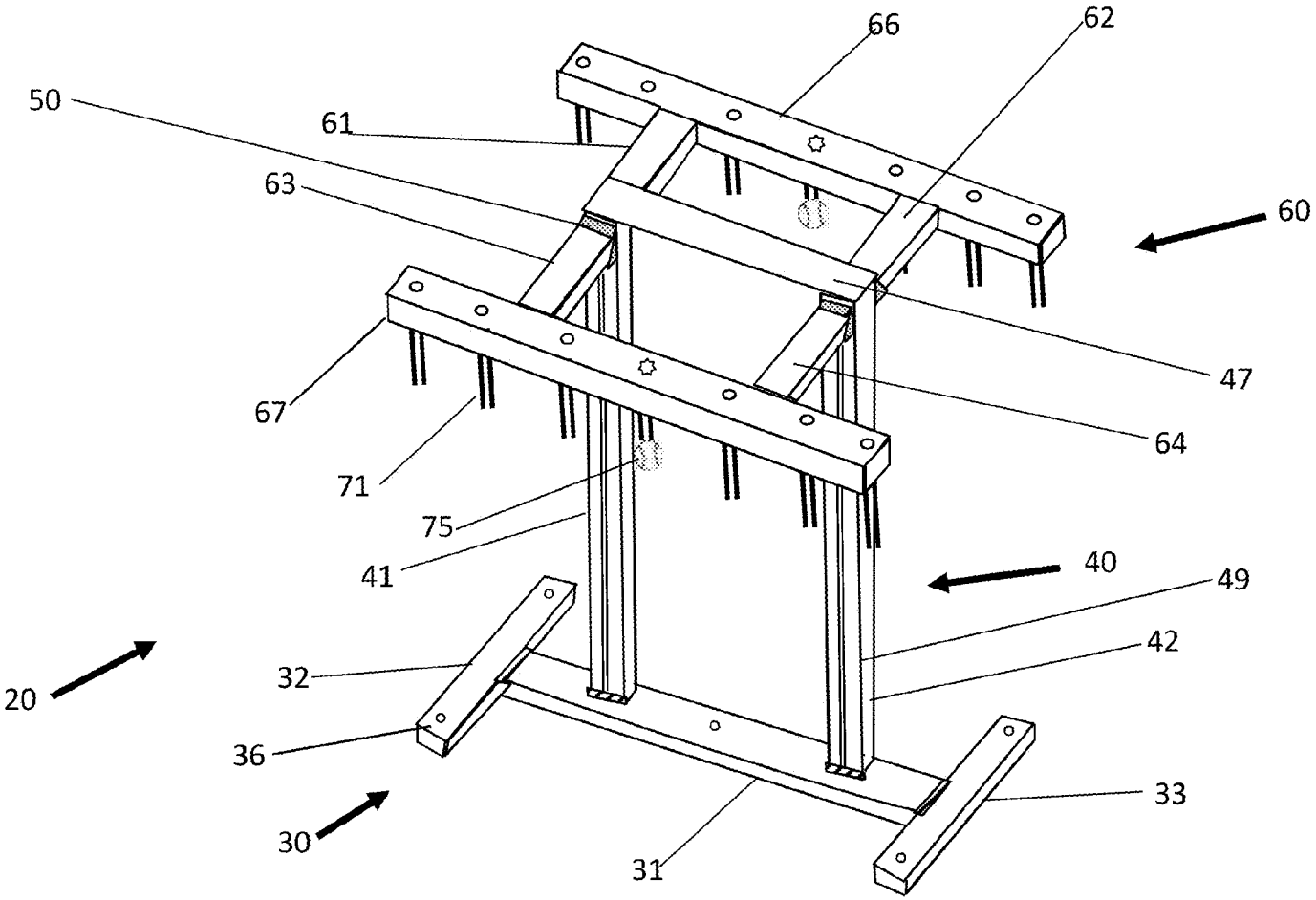

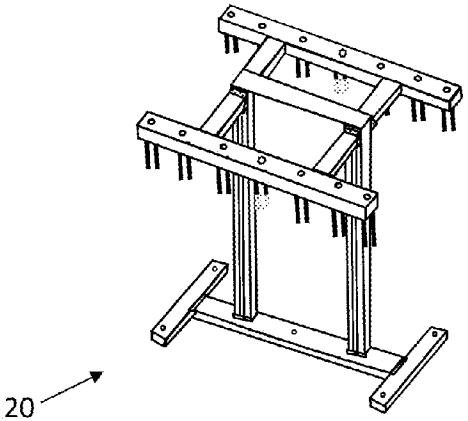
Fig. 1 A
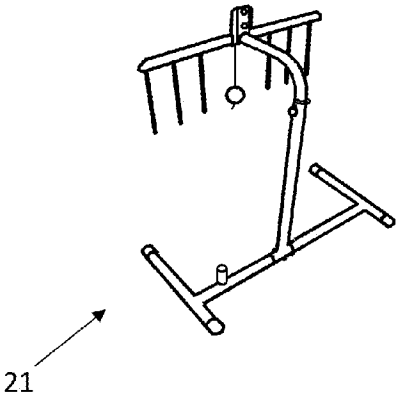
Fig. 1 B
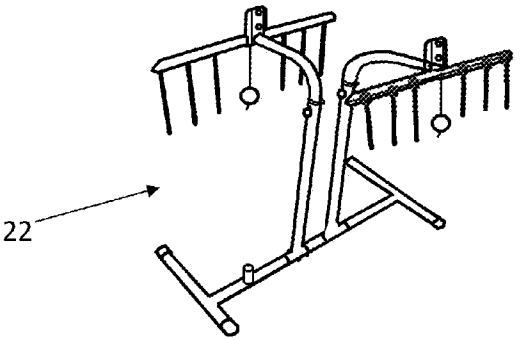
Fig. 1 C
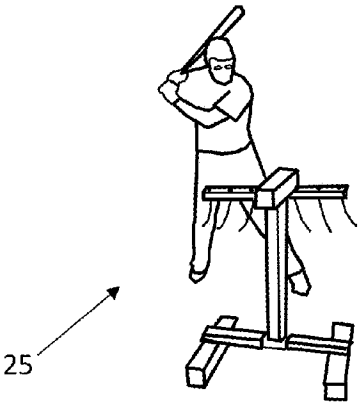
Fig. 1 D
Figs. 1

Top View

Left Side View

Rear View

Section B-B
P°
Λ°
B
B
20
30
40
60
61
62
63
64
65
66
67
70
71
71, 72
75
31
32
33
35
36
41
42
45
46
47
50
51

Top and Left Side View

Rear View

Front and Top View

Top and Right Side View

Top and Front View

Tilt Plane with Top Structure

Tilt Plane with Strap Length

BATTING TRAINING DEVICE FOR TEACHING A BATTER TO BAT AT A LEVEL SWING PLANE

CROSS-REFERENCE TO RELATED APPLICATIONS

This application claims the benefit of United States Provisional Patent Application with Ser. No. 61/902,828 filed Nov. 12, 2013 by David Pressley and entitled "A special baseball training device for batting with a level swing called a Swing Plane".

FIELD OF INVENTION

This invention relates to a special baseball training device for batting with a level swing called a Swing Plane. The present disclosure relates generally to a product that is developed as a training device for a large number of swing repetitions in order to create muscle memory. The device is built with a frame to establish a Plane and to withstand wear and tear of many swings as well as transport of the training device.

Generally, the present invention relates to a baseball swing trainer and, more specifically, to a training-device for perfecting the baseball swing of the batter. This invention relates to a baseball bat swing training apparatus for assisting a baseball player in practicing his swing for insuring a proper swing. It may be used as a practice device for baseball or softball. The present invention relates to improvements in batting practice apparatus, and more particularly, to an apparatus that is useful, for example, in practicing and perfecting batting swings of baseball players, and in improving the level or planar control of their swings. The present invention relates generally to baseball training devices and, more particularly, to a guide for training a batter to pattern his swing in a desirable manner.

FEDERALLY SPONSORED RESEARCH

None.

SEQUENCE LISTING OR PROGRAM

None.

BACKGROUND—FIELD OF INVENTION AND PRIOR ART

A. Background

Baseball has been referred to as America's Pastime. For over one hundred years its popularity as both a spectator event and recreational activity has not diminished. Nearly every community has youth leagues where children as young as five years old participate in organized baseball games. One of the most difficult skills for a young player to learn is to swing the baseball bat level. Indeed, players of all ages, including professional baseball players, continually practice their swing. A level swing provides optimum contact with the ball produces the most power and, hence, increases the probability of achieving a "base hit".

A desirable characteristic of baseball players is that they possess acceptable hitting skills. Two of the most important contributors to good hitting are power and the ability to swing so as to have the bat meet the ball. The type of swing which is most desirable is a level swing. From that initial type of swing, a batter may proceed to strike the lower side of a ball to induce a fly ball or strike the top side of the ball to induce a grounder. In either event, it is important for the batter to have the bat make good contact with the ball. Some players, try as they might, have extreme difficulty with producing a level swing.

Many coaches would agree that the bat should pass through the contact zone in a "level" position. But some may offer different views if we were to ask; "level in reference to what?" Ted Williams, said it over 60 years ago: "Swing level to the ball-not level to the ground." He was right then and he is still right today. Why hasn't the coaches and players listened to "baseball's greatest hitter?" The guiding principle behind the proper swing is for the hitter to "match the plane of his swing to the plane of the pitch." This is a dynamic moment in the rotational swing which allows the hitter to maximize the bat-ball contact area. Contrary to "popular" belief (read: conventional wisdom), this is NOT a result of "swinging up." To plane the pitch means to put the swing of the bat in the same plane as the ball, which is moving at a slight angle down from the pitcher's hand to catcher's glove. A hitter who swings down on the ball has about 4 or 5 inches of contact area. A hitter who swings level to the ground has about 8 inches of contact area. Hitters who plane the pitch have 14 to 22 inches of contact area. In any case, at least in baseball and fast-pitch softball, timing the bat with the ball separates a good hitter from a great hitter. Having the bat and ball on the same plane increases the timing for a good hit.

Throughout the years many attempts have been made to develop a baseball swing trainer or warm up device which is uncomplicated in structure, economic to produce, adjustable to different size hitters, and allows for automatic return of the baseball to a starting position. These devices have included various methods of suspending a ball from a rope mounted to a horizontal support member; attaching a ball to a rigid member; or combinations of the two, such as a suspending a rope with a portion of the rope passing through a tube positioned immediately above the ball.

Known baseball swing training devices are often inadequate in providing feedback regarding proper lower body positioning that is required to develop proper lower body position muscle memory throughout a swing. What is needed in the art is a new baseball swing training device that correctly positions a batter s lower body throughout the swing. Ideally, such a new baseball swing training device would be portable, simple to use, capable of use by a sole batter and capable of use by batters without the need for constant supervision. The most current prototype and idea for the product is developed as a training device for a large number of swing repetitions in order to create muscle memory. There are many baseball and softball swing training aids on the market today. But many these known baseball and softball swing training aids train a batter's upper body. It is known that baseball and softball players improve hitting ability through repetition and muscle memory. This is a key factor used in producing a level baseball swing. Develop what is commonly called "muscle memory" of a proper swing. In essence, repeatedly executing a level swing allows the utilized muscle groups to "remember" what a level swing feels like so that proper execution becomes automatic. Swing training devices, therefore, are designed to allow immediate feedback to the hitter to consistently and repeatedly produce the desired level swing. The ideal swing trainer would address this need.

B. Problem Addressed

Most existing devices do not allow the spatial position of the baseball bat to be influenced by the practice device during the swinging motion. The position of the bat in space at the point in time when it meets the ball, however, plays a crucial role. It would also be desirable to provide a ball hitting practice device that is capable of consistently placing a ball to a user in a consistent and natural manner. It would additionally be desirable to provide a stable ball hitting practice device that is simple to make and use. It would still be more desirable to provide a ball hitting practice device that includes a ball mounting assembly, which can be vertically and angularly adjusted. Finally, the device should be versatile enough to be used for both left and right-handed hitters.

Unfortunately, the ideal swing trainer has not yet been achieved. Known ball striking devices have either failed to duplicate the normal striking position of a well struck pitched ball, failed to provide a realistic feel and flight of a well struck pitched ball, are overly complex, or are too expensive to manufacture to allow purchase for coaches and ball players. Accordingly, there is still a continuing need for improved baseball swing trainers. The present invention fulfills this need, and further provides related advantages.

C. Prior Art

Figure 9A:
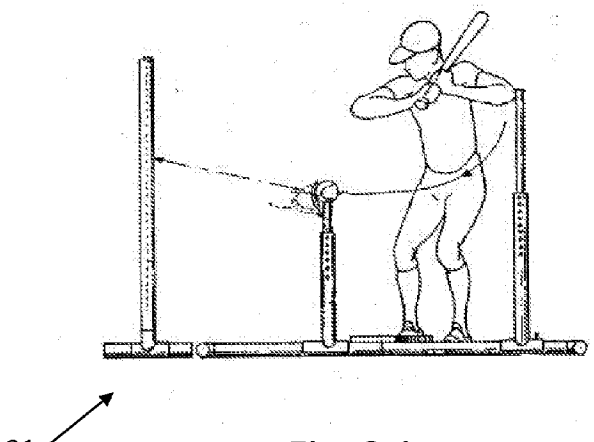
Fig. 9 A Prior Art
Figure 9B:
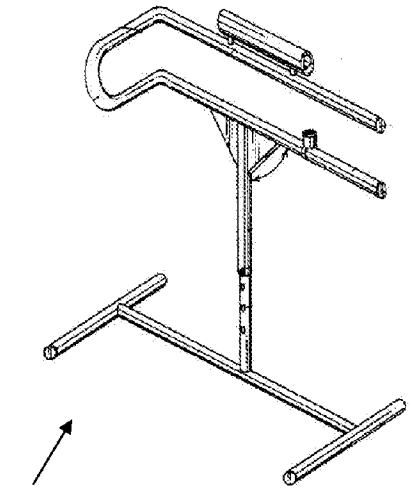
Fig. 9 B Prior Art
Figure 9C:
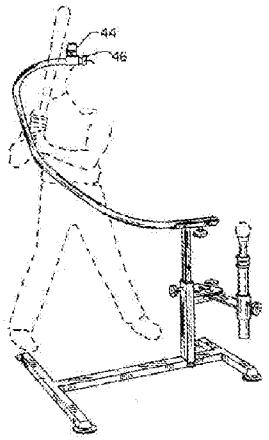
Fig. 9 C Prior Art
Figure 10B:
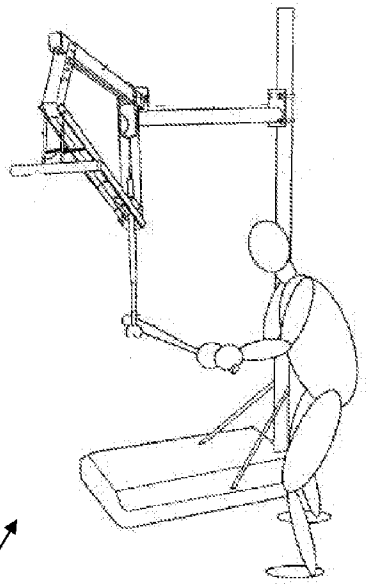
Fig. 10 B Prior Art
Figure 10A:
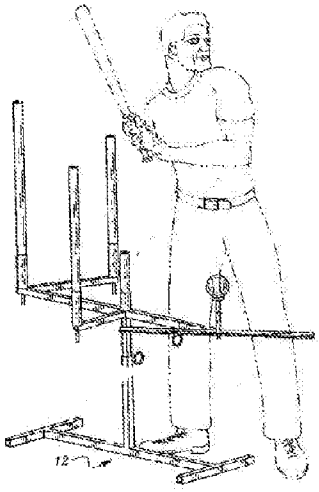
Fig. 10 A Prior Art
Figure 10C:
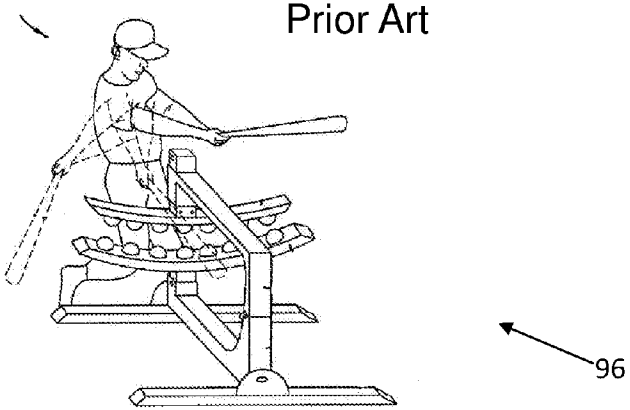
Fig. 10 C Prior Art

FIGS. 9 and 10 are prior art devices and are examples of more expensive and more complicated prior art devices for batter assists. The all have significant limitations which are readily apparent from their drawings and descriptions. The comparison of the new baseball training device for batting with a level swing called a Swing Plane will be addressed fully with the non-provisional application but is not required for the provisional application. Here are shown in FIG. 9, prior art batter trainer device—U.S. Pat. No. 4,886,267 issued to Licciardi, et al. (1989) showing a baseball practice apparatus. Then, prior art device—U.S. Pat. No. 5,087,039 issued to Laseke (1992) shows a Baseball bat swing training device. Prior art device—U.S. Pat. No. 5,322,276 issued to Hardison, Jr. (1994) demonstrates a bat swing guide.

In FIG. 10, further batter training devices are shown as: prior art device—U.S. Pat. No. 6,878,077 issued to Andrews (2005) and teaches another baseball training device. Next, prior art device—U.S. Pat. No. 7,131,916 issued to Griffin (2006) shows and portrays a baseball swing trainer. Finally, prior art device—US Patent Application Publication 2008/0248900 by Hernandez demonstrates a practice baseball swing device. None anticipate nor render obvious the special baseball training device 20 for batting with a level swing called a Swing Plane.

Notably, the aforementioned special baseball training device for batting with a level swing called a Swing Plane include components intended to provide an apparatus and method which overcomes the aforementioned inadequacies of the prior art batting devices. As far as known, there are no batting systems and devices with easily adapted level training components. It is believed that this swing plane product is unique in its design and technologies to provide a baseball player with repetition and muscle memory techniques to improve that player's swing.

SUMMARY OF THE INVENTION

The present invention is a special baseball training device for batting with a level swing called a Swing Plane. The preferred embodiment of the device is a batter assist trainer device called a Swing Plane made of durable materials and comprised of: (a) a counterbalancing base structure configured with a means to removably connect to a vertical frame; (b) the vertical frame with a top beam and a means to connect to a top hanging plane structure; (c) the hanging frame plane structure comprised of at least one side which is further comprised as: (i) a top hanging beam with a means for removably connecting both vertically and pivotally to the vertical frame top beam; (ii) a plurality of straps on either side of a ball; and (iii) the ball with a means for connecting to the top hanging beam wherein the batter may swing a bat at a given plane of swing with a predetermined vertical height and angle to the horizon of a turf or ground.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

OBJECTS AND ADVANTAGES

The Advantages and Benefits of the special baseball training device for batting with a level swing called a Swing Plane include, for example, but are not limited to:

| Item | Advantages |
|---|---|
| 1 | Is easily assembled with simple tools |
| 2 | provides a non-complex design allows for economical production costs, thereby making the swing trainer affordable to many players and coaches |
| 3 | is useable by right and left- batting players |
| 4 | Is made of durable material for long lasting use |
| 5 | is capable of consistently placing a ball through the same or similar path |
| 6 | can be adjusted vertically and angularly to mimic the plane of a pitched ball |

Other features and advantages of the present invention will be apparent from the following more detailed description of the preferred embodiments, taken in conjunction with the accompanying drawings which illustrate, by way of example, the principles of the invention.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

In the accompanying drawings, which are incorporated in and constitute a part of this specification, illustrate an embodiment of a special baseball training device for batting with a level swing called a Swing Plane. The drawings together with the summary description given above and a detailed description given below serve to explain the principles of a special baseball training device for batting with a level swing called a Swing Plane. It is understood, however, that the special apparatus and system for batter assist in achieving a consistent swinging plane is not limited to only the precise arrangements and instrumentalities shown.

BRIEF DESCRIPTION OF THE DRAWINGS—FIGURES

FIGS. 1 A through 1 D are various sketches of the special baseball training device for batting with a level swing called a Swing Plane.

FIG. 2 is an isometric sketch of a special baseball training device for batting with a level swing called a Swing Plane with several of the components and interconnections shown.

Figures 3A, 3B, 3C, 3D:
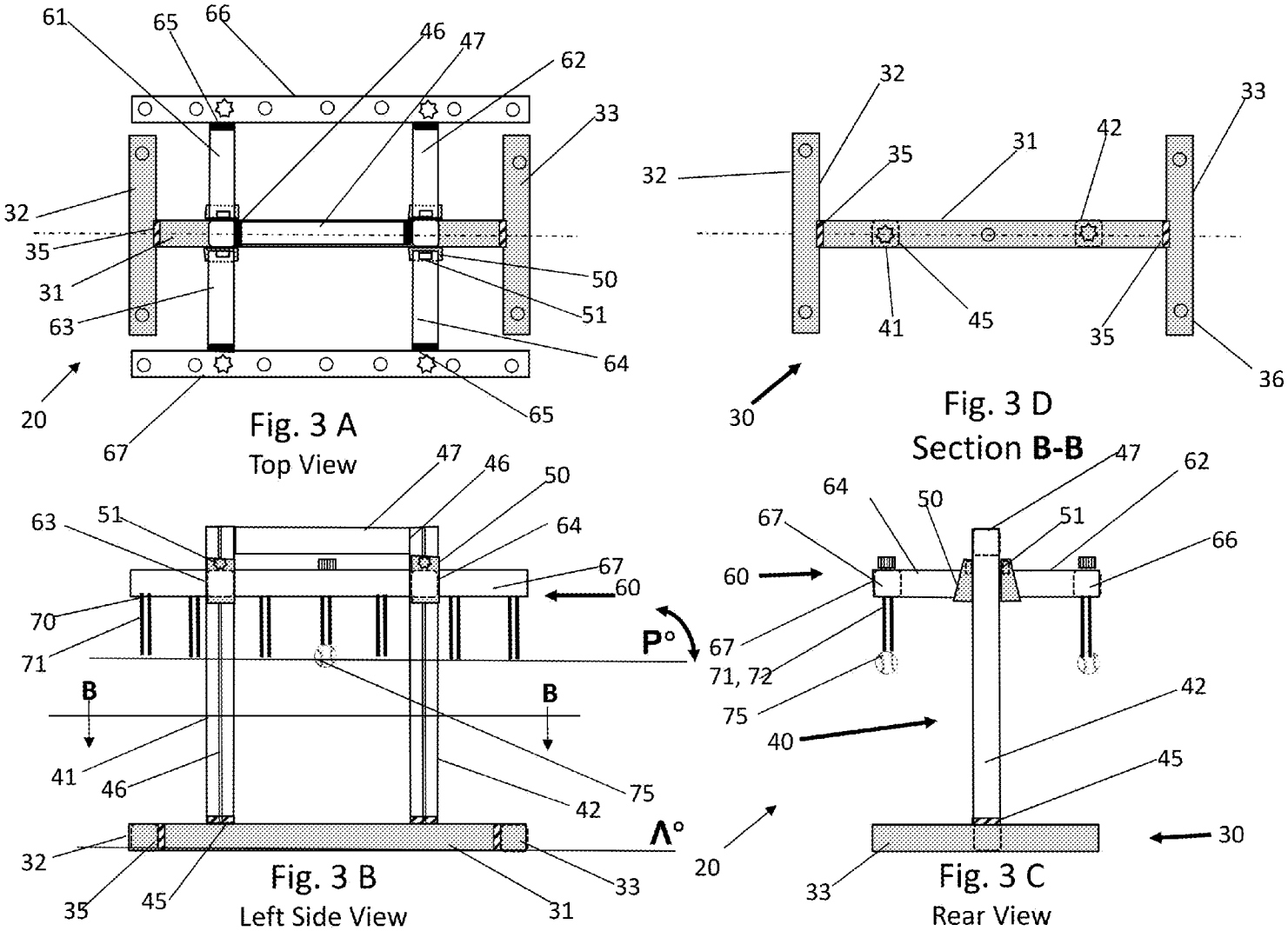

FIGS. 3 A through 3 D are further sketches of the special baseball training device for batting with several more of the components and interconnections shown and described herein.

Figures 4A, 4B:
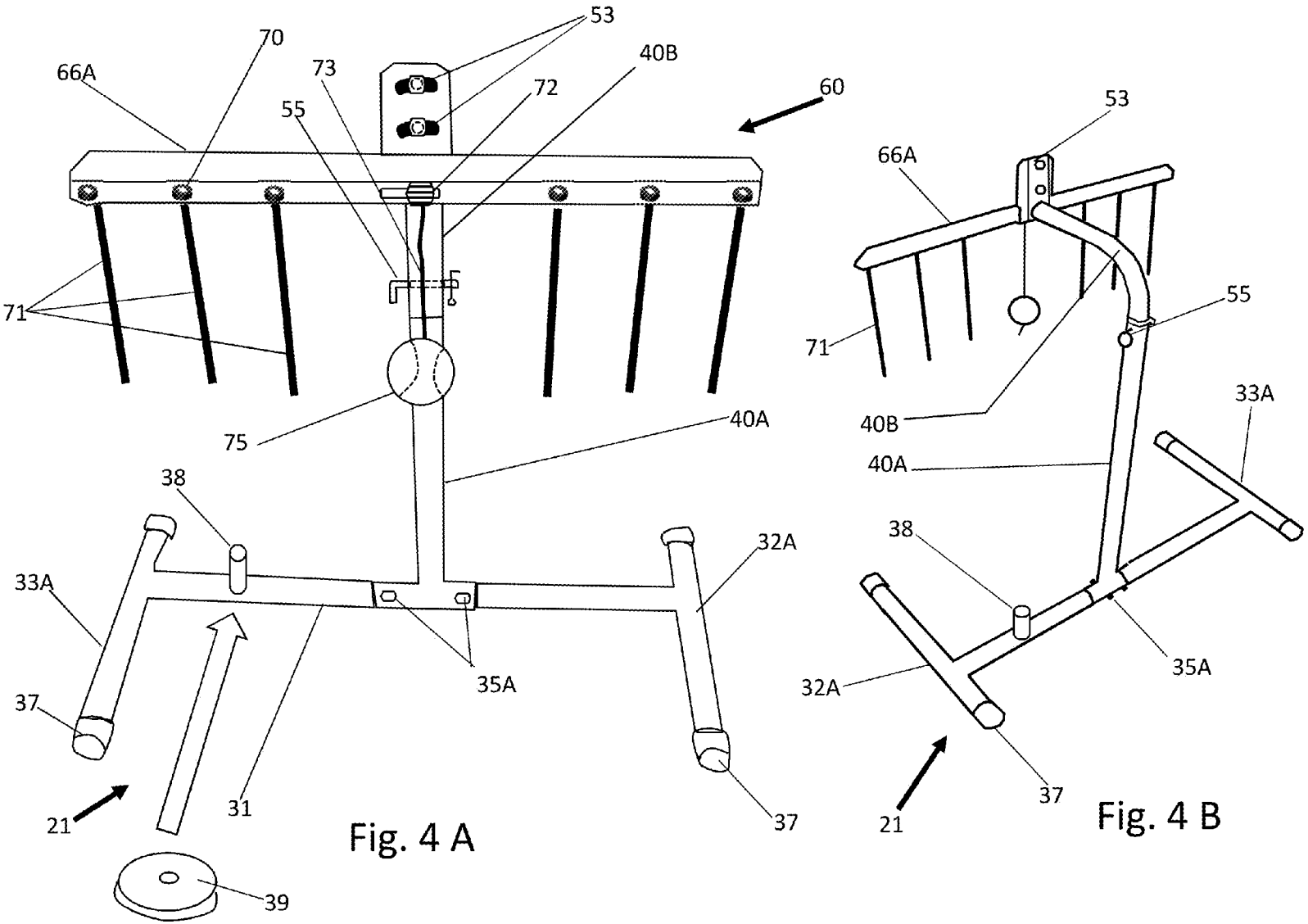

FIGS. 4 A and 4 B are sketches of the preferred baseball training device for batting with a level swing called a Swing Plane having a single side.

Figure 5C:
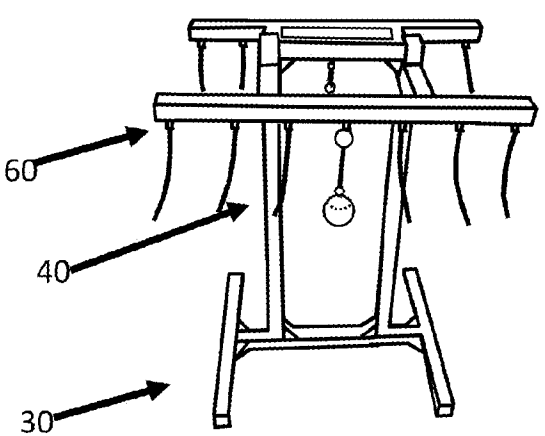
Figure 5B:
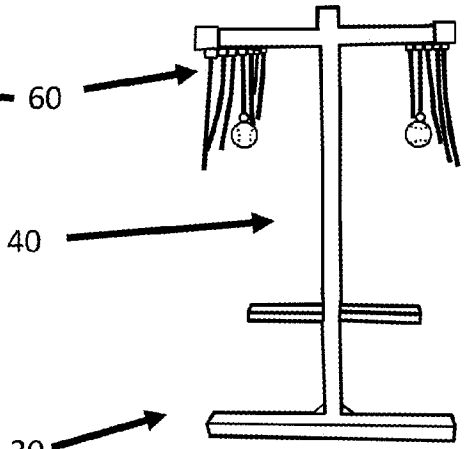
Figure 5A:
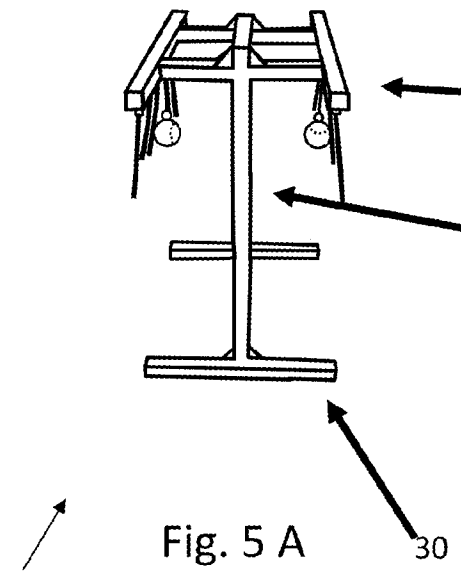
Figure 6A:
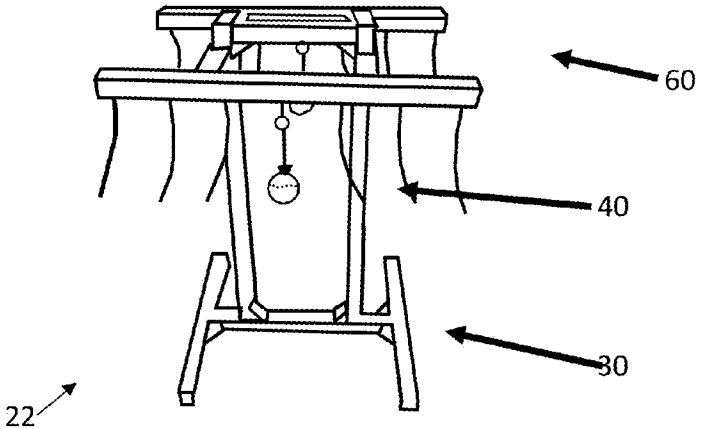
Figure 6B:
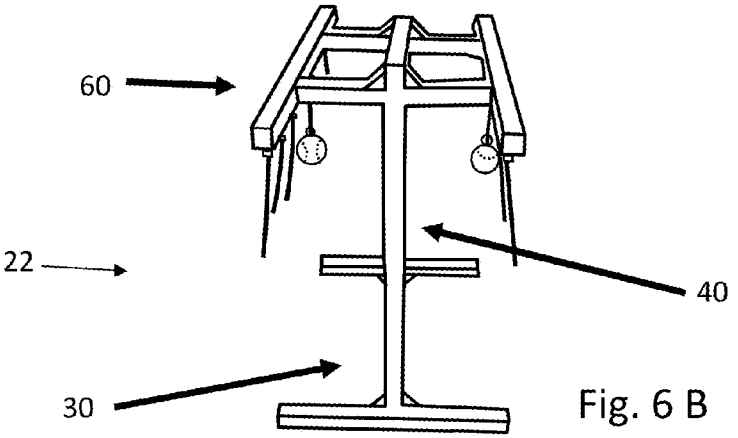
Figure 6C:
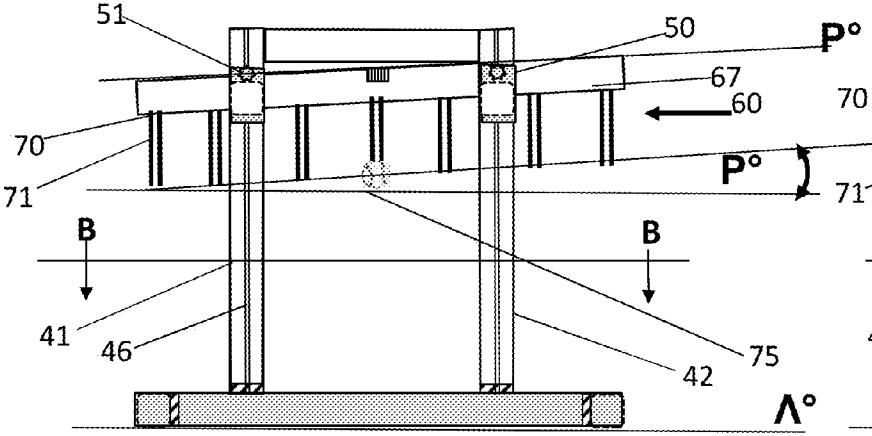
Figure 6D:
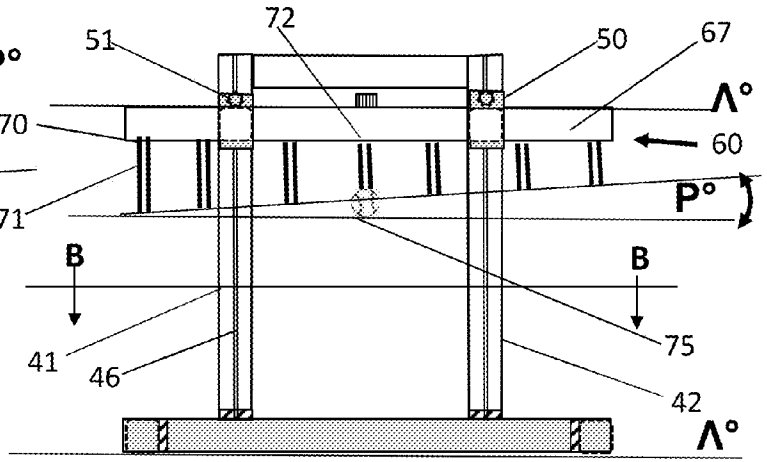

FIG. 5 A through 5 C show sketches of the prototype 2 of the special baseball training device for batting with a level swing called a Swing Plane.

FIGS. 6 A and 6 B show additional sketches of the prototype 2 of the special baseball training device for batting with a level swing called a Swing Plane. FIGS. 6 C and 6 D show methods to change the swing plane angle.

Figures 7A, 7B, 7C, 7D, 7E, 7F:
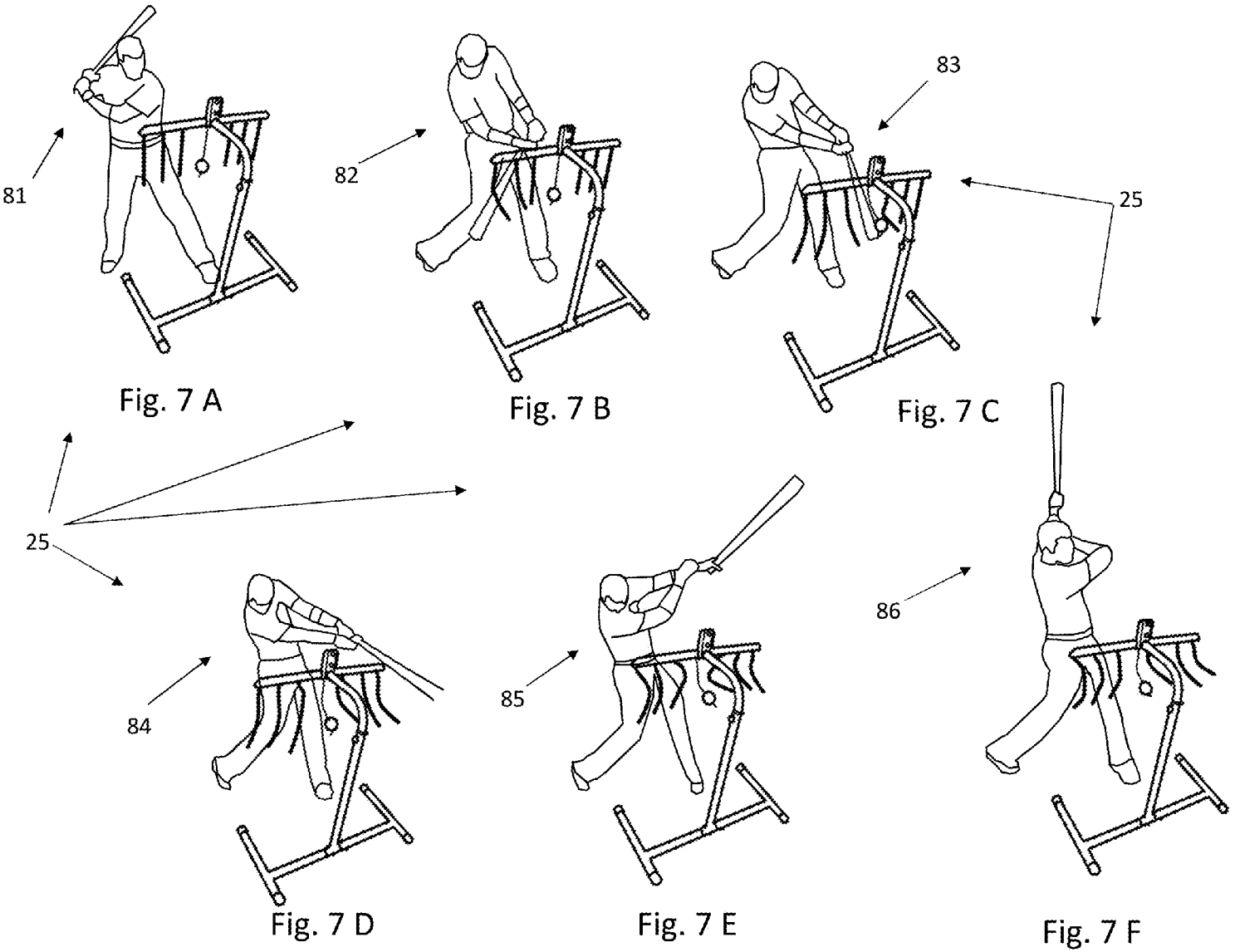

FIG. 7 A through 7 F are sketches showing the operational use of the special baseball training device by a batter.

Figures 8A, 8B:
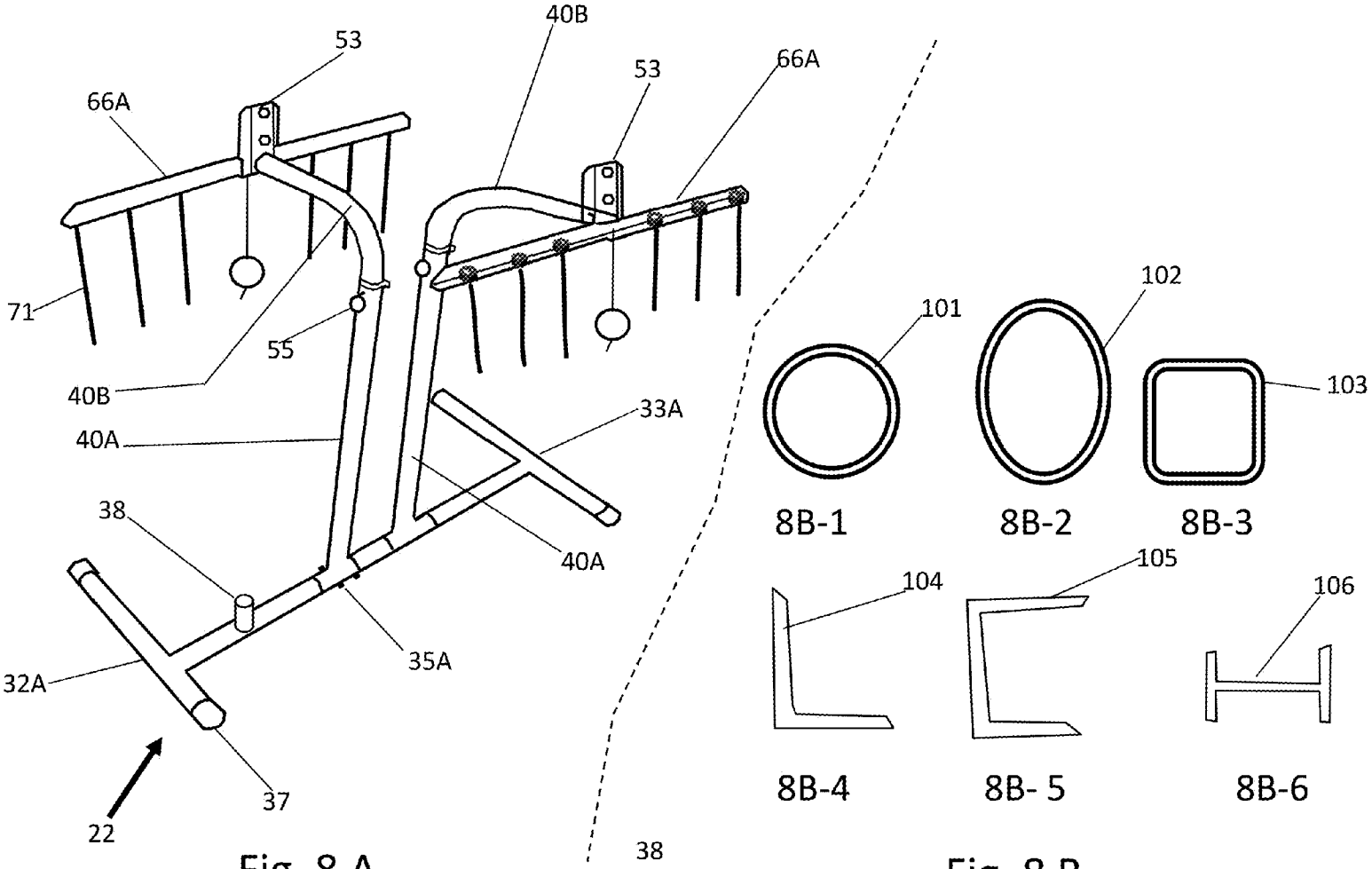

FIG. 8 A is a sketch of the preferred baseball training device for batting with a level swing called a Swing Plane having double sides. FIG. 8 B-1 through 8 B-6 are examples of cross-sections of typical structural members.

FIGS. 9 A through 9 C are prior art batter assist devices.

FIGS. 10 A through 10 C are more prior art batter assist devices.

DESCRIPTION OF THE DRAWINGS—REFERENCE NUMERALS

The following list refers to the drawings:

TABLE A

Reference numbers

| Ref # | Description |
|---|---|
| 20 | a special baseball training device 20 for batting with a level swing called a Swing Plane |
| 21 | the preferred baseball training device 21 for batting with a level swing called a Swing Plane having a single side |
| 22 | a baseball training device 22 for batting with a level swing called a Swing Plane having double sides |
| 25 | the special baseball training device 20 for batting with a level swing called a Swing Plane shown in operation 25 |
| 30 | base unit 30 in general with stabilizing configuration to enable support of vertical structure 40 and top hanging plane structure 60 |
| 31 | longitudinal structure 31 for example a center tubular beam |
| 32 | front lateral structural member 32, for example a tubular beam to be act as a stabilizing spreader for the base 30 |
| 32A | front lateral structural member 32A, for example a tubular beam to be act as a stabilizing spreader for the base 30 of a preferred device 21 |
| 33 | rear lateral structural member 33, for example a tubular beam to be act as a stabilizing spreader for the base 30 |

TABLE A-continued

Reference numbers

| Ref # | Description |
|---|---|
| 33A | rear lateral structural member 33A, for example a tubular beam to be act as a stabilizing spreader for the base 30 of a preferred device 21 |
| 35 | means 35 for removably connecting longitudinal base 31 to lateral spreaders 32, 33 |
| 35A | means 35A for removably connecting vertical tee structure 40A to lateral structure members 32A, 33A |
| 36 | apertures 36 in base 31 and lateral spreaders 32, 33 for optional hold-down stakes |
| 37 | end caps or a means to close the lateral structure members 32A, 33A |
| 38 | optional weight post 38 |
| 39 | counter weight 39 |
| 40 | vertical structure 40 |
| 40A | vertical Tee structure 40A of a preferred device 21 with apertures for accepting means 55 |
| 40B | vertical Ell structure 40B of a preferred device 21 with telescoping features for accepting vertical tee 40A and apertures for accepting means 55 |
| 41 | front vertical structural column 41 or post, for example a tubular beam |
| 42 | back vertical structural column 42 or post, for example a tubular beam |
| 45 | means 45 for removably connecting columns 41, 42 to base 30 (or center beam 31), for example threaded bolts and threaded plates, pins and aperture, detent spring held pins and the like |
| 46 | means 46 for removably connecting columns 41, 42 to top center beam 47, for example threaded bolts and threaded plates, pins and aperture, detent spring held pins and the like |
| 47 | top center beam 47, |
| 49 | vertical receiving aperture 49 or U channel or equal for receiving means 50 |
| 50 | means 50 for removably connecting columns 41, 42 to top spreader wings members 61, 62, 63, and 64, for example a structural half box or channel with threaded bolts and threaded plates, pins and aperture, detent spring held pins and the like to engage the vertical receiving aperture 49 in the vertical posts 41, 42 |
| 51 | means 51 for easily locking means 50 at various heights in the channel 49 such that the front and rear spreader wings 61-64 may be at different heights such that the hanging beams 66, 67 may be at a desired swing plane P(Rho)with angle Λ (Lambda) with the horizon |
| Λ | angle Λ (Lambda) of the horizon (normally zero) |
| P | desired swing plane P(Rho) |
| 53 | means 53 for removably connecting hanger beams 66A of a preferred device 21 or double device 22 the vertical Ell 40B. For example a structural half box or channel with threaded bolts and threaded plates, pins and aperture, detent spring held pins and the like to engage the vertical eel 40B to the means. Means 53 slotted or has multiple off-set apertures to permit so that the bar 66A may be at a desired swing plane P(Rho)with angle Λ (Lambda) with the horizon |
| 55 | means 55 for removably connecting vertical tee 40A and vertical eel 40B and for adjusting the length of the two pieces (40A and 40B) when connected. For example threaded bolts and threaded plates, pins and aperture, detent spring held pins and the like |
| 60 | top hanging plane structure 60 |
| 61 | front right 61 top spreader wings members |
| 62 | back right 62 top spreader wings members |
| 63 | front left 63 top spreader wings members |
| 64 | back left 64 top spreader wings members |
| 65 | means 65 for removably connecting top spreader wings members 61, 62, 63, and 64, to hanger beams 66, 67 for example threaded bolts and threaded plates, pins and aperture, detent spring held pins and the like |
| 66 | right hanger beams 66 |
| 66A | hanger beam 66A of a preferred device 21 or double device 22 |
| 67 | left hanger beams 66 |
| 70 | means 70 for removably connecting and adjustably hanging a strap 71 from the hanger beam 66, 67 - for example a treaded fastener, pin, rod, clasp or equal |

TABLE A-continued

| Reference numbers | |
|---|---|
| Ref # | Description |
| 71 | flexible hanging straps 71 to give sight gauge of swing plane P to batter 77 |
| 72 | means 72 for removably connecting and adjustably hanging a ball 75 from the hanger beam 66, 66A, 67 - for example a treaded fastener, pin, rod, clasp or equal |
| 73 | flexible hanger member 73 such as a rope, cable or strap to connect means 72 to ball 75 |
| 75 | baseball or softball |
| 77 | practicing batter 77 |
| 79 | bat |
| 81 | batter 77 with bat 78 at ready to swing position 81 |
| 82 | batter 77 with bat 78 at start of plane, pre-ball position 82 |
| 83 | batter 77 with bat 78 past ball, still on swing plane position 83 |
| 84 | batter 77 with bat 78 starting to exit swing plane position 84 |
| 85 | batter 77 with bat 78 at post plane and carrying through swing position 85 |
| 86 | batter 77 with bat 78 at end of swing with full carry through position 86 |
| 91 | prior art device - U.S. Pat. No. 4,886,267 - 91 |
| 92 | prior art device - U.S. Pat. No. 5,087,039 - 92 |
| 93 | prior art device - U.S. Pat. No. 5,322,276 - 93 |
| 94 | prior art device - U.S. Pat. No. 6,878,077 - 94 |
| 95 | prior art device - U.S. Pat. No. 7,131,916 - 95 |
| 96 | prior art device - U.S. Patent Application Publication 2008/0248900 - 96 |
| 101 | Structural Cross-section Hollow Round Tube 101 |
| 102 | Structural Cross-section Hollow Elliptical Tube 102 |
| 103 | Structural Cross-section Hollow Square or Rectangular Tube 103 |
| 104 | Structural Cross-section Angle iron or "Ell" 104 |
| 105 | Structural Cross-section Channel iron or "Cee" 105 |
| 106 | Structural Structure Cross-section beam or "I" or "W" beam Component 106 |

DETAILED DESCRIPTION OF PREFERRED EMBODIMENT

The present development is a special baseball training device for batting with a level swing called a Swing Plane. This invention relates to a special baseball training device for batting with a level swing called a Swing Plane. The present disclosure relates generally to a product that is developed as a training device for a large number of swing repetitions in order to create muscle memory. The device is built with a frame to establish a Plane and to withstand wear and tear of many swings as well as transport of the training device.

The present invention relates to a baseball swing trainer and, more specifically, to a training device for perfecting the baseball swing of the batter. This invention relates to a baseball bat swing training apparatus for assisting a baseball player in practicing his swing for insuring a proper swing. It may be used as a practice device for baseball or softball. The present invention relates to improvements in batting practice apparatus, and more particularly, to an apparatus that is useful, for example, in practicing and perfecting batting swings of baseball players, and in improving the level or planar control of their swings. The present invention relates generally to baseball training devices and, more particularly, to a guide for training a batter to pattern his swing in a desirable manner.

The special baseball training device 20 for batting with a level swing called a Swing Plane has several advantages and benefits. The Advantages and Benefits of the special include, for example, but are not limited to:

1. Is easily assembled with simple tools;
2. Provides a non-complex design allows for economical production costs, thereby making the swing trainer affordable to many players and coaches;
3. Is useable by right and left-batting players;
4. Is made of durable material for long lasting use;
5. Is capable of consistently placing a ball through the same or similar path; and
6. Can be adjusted vertically and angularly to mimic the plane of a pitched ball.

The preferred embodiment of the device is a batter assist trainer device called a Swing Plane made of durable materials and comprised of: (a) a counterbalancing base structure configured with a means to removably connect to a vertical frame; (b) the vertical frame with a top beam and a means to connect to a top hanging plane structure; (c) the hanging frame plane structure comprised of at least one side which is further comprised as: (i) a top hanging beam with a means for removably connecting both vertically and pivotally to the vertical frame top beam; (ii) a plurality of straps on either side of a ball; and (iii) the ball with a means for connecting to the top hanging beam wherein the batter may swing a bat at a given plane of swing with a predetermined vertical height and angle to the horizon of a turf or ground.

The accompanying drawings, which are incorporated in and constitute a part of this specification, illustrate an embodiment of the special baseball training device 20 for batting with a level swing called a Swing Plane. The drawings together with the summary description given above and a detailed description given below serve to explain the principles of device 20 for a batter 77.

There is shown in FIGS. 1-10 a description and operative embodiment of the special baseball training device 20 for batting with a level swing called a Swing Plane. In the drawings and illustrations, one notes well that the FIGS. 1-6 and 8 demonstrate the general configuration, and FIG. 7 shows examples but not limitations of the uses. These are described in the operation and use section, below. FIG. 9 and FIG. 10 are examples of prior art.

FIGS. 1 A through 1 D are various sketches of the special baseball training device 20 for batting with a level swing called a Swing Plane. Included are the preferred baseball training device 21 for batting with a level swing called a Swing Plane having a single side; a baseball training device 22 for batting with a level swing called a Swing Plane having double sides; and a batter 77 practicing with the new device 20 in operation 25.

FIG. 2 is an isometric sketch of the first concept of a special baseball training device 20 for batting with a level swing called a Swing Plane with several of the components and inter-connections shown. Shown are the base unit 30 in general with stabilizing configuration to enable support of vertical structure 40 and top hanging plane structure 60; the longitudinal structure 31 for example a center tubular beam; the front lateral structural member 32, for example a tubular beam to be act as a stabilizing spreader for the base 30; the rear lateral structural member 33, for example a tubular beam to be act as a stabilizing spreader for the base 30; a plurality of apertures 36 in base 31 and lateral spreaders 32, 33 for optional hold-down stakes; the vertical structure 40 with a front vertical structural column 41 or post, for example a tubular beam; a back vertical structural column 42 or post, for example a tubular beam; vertical receiving aperture 49 or U channel or equal for receiving means 50; the means 50 for removably connecting columns 41,42 to top spreader wings members 61, 62, 63, and 64, for example a structural half box or channel with threaded bolts and threaded plates, pins and aperture, detent spring held pins and the like to engage the vertical receiving aperture 49 in the vertical posts 41, 42; a top hanging plane structure 60; a front right 61 top spreader wings members; aback right 62 top spreader wings members; a front left 63 top spreader wings members; a back left 64 top spreader wings members; a pair of hanger beams 66, 67 including a right hanger beams 66 and left hanger beams 66; a plurality of flexible hanging straps 71 to give sight gauge of swing plane P to batter 77 (batter and angle not shown); and a baseball or softball 75.

FIGS. 3 A through 3 D are further sketches of the first concept of a special baseball training device for batting with several more of the components and inter-connections shown and described herein. FIG. 3 A is a Top View, FIG. 3 B is a Left Side View, FIG. 3 C is a Rear End or Back Side View, and FIG. 3 D is a Section B-B View of the base 30. Shown here are the above described components and other components (mainly connecting means and such) for the special baseball training device 20 for batting with a level swing called a Swing Plane. Included here are: the base unit 30 in general with stabilizing configuration to enable support of the vertical structure 40 and the top hanging plane structure 60; the longitudinal structure 31 for example a center tubular beam; a front lateral structural member 32, for example a tubular beam to be act as a stabilizing spreader for the base 30; a rear lateral structural member 33, for example a tubular beam to be act as a stabilizing spreader for the base 30; a means 35 for removably connecting longitudinal base 31 to lateral spreaders 32, 33; a plurality of apertures 36 in base 31 and lateral spreaders 32, 33 for optional hold-down stakes; the vertical structure 40; the front vertical structural column 41 or post, for example a tubular beam/column; the back vertical structural column 42 or post, for example a tubular beam/column; a means 45 for removably connecting columns 41,42 to base 30 (or center beam 31), for example threaded bolts and threaded plates, pins and aperture, detent spring held pins and the like; a means 46 for removably connecting columns 41,42 to top center beam 47, for example threaded bolts and threaded plates, pins and aperture, detent spring held pins and the like; the top center beam 47; a vertical receiving aperture 49 or U channel or equal for receiving means 50 in each post 41, 42; a means 50 for removably connecting columns 41,42 to top spreader wings members 61, 62, 63, and 64, for example a structural half box or channel with threaded bolts and threaded plates, pins and aperture, detent spring held pins and the like to engage the vertical receiving aperture 49 in the vertical posts 41, 42; a means 51 for easily locking means 50 at various heights in the channel 49 such that the front and rear spreader wings 61-64 may be at different heights such that the hanging beams 66, 67 may be at a desired swing plane P(Rho) with angle Λ (Lambda) with the horizon; a top hanging plane structure 60; a front right 61 top spreader wings members; a back right 62 top spreader wings members; a front left 63 top spreader wings members; a back left 64 top spreader wings members; a means 65 for removably connecting top spreader wings members 61, 62, 63, and 64, to hanger beams 66, 67 for example threaded bolts and threaded plates, pins and aperture, detent spring held pins and the like; a right hanger beams 66; a left hanger beams 66; a means 70 for removably connecting and adjustably hanging a strap 71 from the hanger beam 66, 67—for example a treaded fastener, pin, rod, clasp or equal; a flexible hanging straps 71 to give sight gauge of swing plane P (not shown) to batter 77 (not shown); a means 72 for removably connecting and adjustably hanging a ball 75 from the hanger beam 66, 67—for example a treaded fastener, pin, rod, clasp or equal; a flexible hanger member 73 such as a rope, cable or strap to connect means 72 to ball 75; and a baseball or softball 75. As to the straps 71, the intent for each swing on the device 20 is to contact each piece of hanging material 71 before the baseball 75, the baseball 75, and then each piece of hanging material 71 after the baseball with the sweet spot of the bat. The approximate length of the simulated swing plane on the device is 36 inches. This length seems natural and will continue to be monitored. There is not a resistance factor to the material hanging 71 on the plane P. Note in FIG. 3 C that Λ represents the angle (Lambda) of the horizon (normally zero) and that P (Rho) represents the desired swing plane P(Rho). See FIGS. 6 C and 6 D below.

The special baseball training device 20 for batting with a level swing called a Swing Plane is anticipated to be made of a durable, non-marring materials with many different cross-sections. For example, a metal such as an aluminum or alloy, a steel or steel alloy, and strong composite material including several reinforced plastics and the like. All will be corrosive resistant and weather-proof for continuous use outdoors. The coatings may include paint, powder coat, surface finishing such as chrome, galvanize, anodizing and the like or special materials such as stainless steel and Corten anti corrosion steels. The general configurations anticipated are square, rectangular and oval tubes; Channels; I and H beams; and circle/elliptical geometries.

FIGS. 4 A and 4 B are sketches of the preferred service 21. Shown are the preferred baseball training device 21 for batting with a level swing called a Swing Plane having a single side; longitudinal structure 31 for example a center tubular beam formed by the two lateral supports 32A, 32B and the vertical tee 40A; front lateral structural member 32A, for example a tubular beam to be act as a stabilizing spreader for the base 30 of a preferred device 21; rear lateral structural member 33A, for example a tubular beam to be act as a stabilizing spreader for the base 30 of a preferred device 21; means 35A for removably connecting vertical tee structure 40A to lateral structure members 32A,33A; end caps or a means to close the lateral structure members 32A,33A; optional weight post 38; counter weight 39; vertical Tee structure 40A of a preferred device 21 with apertures for accepting means 55; vertical Ell structure 40B of a preferred device 21 with telescoping features for accepting vertical tee 40A and apertures for accepting means 55; means 53 for removably connecting hanger beams 66A of a preferred device 21 or double device 22 the vertical Ell 40B, for example a structural half box or channel with threaded bolts and threaded plates, pins and aperture, detent spring held pins and the like to engage the vertical eel 40B to the means. Means 53 slotted or has multiple off-set apertures to permit so that the bar 66A may be at a desired swing plane P(Rho) with angle Λ (Lambda) with the horizon; means 55 for removably connecting vertical tee 40A and vertical eel 40B and for adjusting the length of the two pieces (40A and 40B) when connected, for example threaded bolts and threaded plates, pins and aperture, detent spring held pins and the like; top hanging plane structure 60; hanger beam 66A of a preferred device 21 or double device 22; means 70 for removably connecting and adjustably hanging a strap 71 from the hanger beam 66, 67—for example a treaded fastener, pin, rod, clasp or equal; flexible hanging straps 71 to give sight gauge of swing plane P to batter 77; means 72 for removably connecting and adjustably hanging a ball 75 from the hanger beam 66, 66A, 67—for example a treaded fastener, pin, rod, clasp or equal; flexible hanger member 73 such as a rope, cable or strap to connect means 72 to ball 75; and baseball or softball.

FIG. 5 A through 5 C show sketches of the prototype 22 of the special baseball training device 20 for batting with a level swing called a Swing Plane. Shown again are the base unit 30 in general with stabilizing configuration to enable support of vertical structure 40 and top hanging plane structure 60; the vertical structure 40; and the top hanging plane structure 60. The components for the devices are shown and described in FIGS. 2 and 3, above.

FIGS. 6 A and 6 B show additional sketches of the prototype 2 of the special baseball training device for batting with a level swing called a Swing Plane. Shown once again are the base unit 30 in general with stabilizing configuration to enable support of vertical structure 40 and top hanging plane structure 60; the vertical structure 40; and the top hanging plane structure 60. The components for the devices are shown and described in FIGS. 2 and 3, above. FIGS. 6 C and 6 D show methods to change the swing plane angle P. FIG. 6 C shows changing the swing plane angle P by tilting the horizontal hanging beams 66, 67. This is done by releasing the means to fasten 51 and dropping or lowering one side along the aperture channel 46 of the posts 41, 42. FIG. 6 D shows changing the swing plane angle P by changing the length of the straps 71 by placing longer or shorter straps at the means 70 to hang the straps 71 and means 72 to hang the ball 75 as desired. Both methods are adaptable for the needs of the practicing batter 77.

FIG. 7 A through 7 F are sketches showing the operational use of the special baseball training device by a batter. These are described in the operation section, below.

FIG. 8 A is a sketch of the baseball training device for batting with a level swing called a Swing Plane having double sides. Shown are the baseball training device 22 for batting with a level swing called a Swing Plane having double sides for use by two batters at one time if desired; longitudinal structure 31 for example a center tubular beam formed by the two lateral supports 32A, 32B and the two vertical tees 40A; front lateral structural member 32A, for example a tubular beam to be act as a stabilizing spreader for the base 30 of a preferred device 21; rear lateral structural member 33A, for example a tubular beam to be act as a stabilizing spreader for the base 30 of a device 22; means 35A for removably connecting the two vertical tee structures 40A to lateral structure members 32A,33A; end caps or a means to close the lateral structure members 32A,33A; optional weight post 38; counter weight 39; vertical Tee structures 40A of a device 22 with apertures for accepting means 55; vertical Ell structures 40B of a preferred device 22 with telescoping features for accepting vertical tees 40A and apertures for accepting means 55; means 53 for removably connecting hanger beams 66A of a double device 22 the vertical Ell 40B, for example a structural half box or channel with threaded bolts and threaded plates, pins and aperture, detent spring held pins and the like to engage the vertical eel 40B to the means. Means 53 slotted or has multiple off-set apertures to permit so that the bar 66A may be at a desired swing plane P(Rho) with angle Λ (Lambda) with the horizon; means 55 for removably connecting vertical tee 40A and vertical eel 40B and for adjusting the length of the two pieces (40A and 40B) when connected, for example threaded bolts and threaded plates, pins and aperture, detent spring held pins and the like; top hanging plane structure 60; hanger beam 66A of a preferred device 21 or double device 22; means 70 for removably connecting and adjustably hanging a strap 71 from the hanger beam 66, 67—for example a treaded fastener, pin, rod, clasp or equal; flexible hanging straps 71 to give sight gauge of swing plane P to batter 77; means 72 for removably connecting and adjustably hanging a ball 75 from the hanger beam 66, 66A, 67—for example a treaded fastener, pin, rod, clasp or equal; flexible hanger member 73 such as a rope, cable or strap to connect means 72 to ball 75; and baseball or softball.

FIG. 8 B-1 through 8 B-6 are examples of cross-sections of typical structural members. These include, for example and not as a limitation, Structural Cross-section Hollow Round Tube 101; Structural Cross-section Hollow Elliptical Tube 102; Structural Cross-section Hollow Square or Rectangular Tube 103; Structural Cross-section Angle iron or "Ell" 104; Structural Cross-section Channel iron or "Cee" 105; and Structural Structure Cross-section beam or "I" or "W" beam Component 106.

FIGS. 9 A through 9 C are and FIGS. 10 A through 10 C are prior art batter assist devices and are examples of more expensive and more complicated prior art devices for batter assists. The all have significant limitations which are readily apparent from their drawings and descriptions. The comparison of the new baseball training device for batting with a level swing called a Swing Plane will be addressed fully with the non-provisional application but is not required for the provisional application. Here are shown in FIGS. 9 A through 9 C, prior art batter trainer device—U.S. Pat. No. 4,886,267—91; prior art device—U.S. Pat. No. 5,087,039—92; and prior art device—U.S. Pat. No. 5,322,276—93. In FIGS. 10 A through 10 C, further batter training devices are shown as: prior art device—U.S. Pat. No. 6,878,077—94; prior art device—U.S. Pat. No. 7,131,916—95; and prior art device—US Patent Application Publication 2008/0248900—96. None anticipate the special baseball training device 20 for batting with a level swing called a Swing Plane.

The details mentioned here are exemplary and not limiting. Other specific components and manners specific to describing a special baseball training device 20 for batting with a level swing called a Swing Plane may be added as a person having ordinary skill in the field of batter assist and training devices and their uses well appreciates.

OPERATION OF THE PREFERRED EMBODIMENT

The special baseball training device 20 for batting with a level swing called a Swing Plane has been described in the above embodiment. The manner of how the device operates is described below. This invention relates to a special baseball training device for batting with a level swing called a Swing Plane. The present disclosure relates generally to a product that is developed as a training device for a large number of swing repetitions in order to create muscle memory. The device is built with a frame to establish a Plane and to withstand wear and tear of many swings as well as transport of the training device. The present invention relates to a baseball swing trainer and, more specifically, to a training device for perfecting the baseball swing of the batter. This invention relates to a baseball bat swing training apparatus for assisting a baseball player in practicing his swing for insuring a proper swing. It may be used as a practice device for baseball or softball. The present invention relates to improvements in batting practice apparatus, and more particularly, to an apparatus that is useful, for example, in practicing and perfecting batting swings of baseball players, and in improving the level or planar control of their swings. The present invention relates generally to baseball training devices and, more particularly, to a guide for training a batter to pattern his swing in a desirable manner.

FIG. 7 A through 7 F are sketches showing the operational use of the special baseball training device 20 by a batter 77. In these sketches are shown: a batter 77 with bat 78 at ready to swing position 81; a batter 77 with bat 78 at start of plane, pre-ball position 82; a batter 77 with bat 78 past ball, still on swing plane position 83; a batter 77 with bat 78 starting to exit swing plane position 84; a batter 77 with bat 78 at post plane and carrying through swing position 85; and a batter 77 with bat 78 at end of swing with full carry through position 86

Uses for the special baseball training device 20 for batting with a level swing called a Swing Plane anticipate the product as designed for baseball and softball hitters. At this point it does not match up with muscle memory that would be applicable to another sport or hobby. The idea is that a baseball or softball hitter can use this unit to develop a swing that stays on the plane of the pitch despite the height or trajectory of the pitch. Creating a swing that stays on the plane and trajectory of the pitch will improve a hitter's chance for solid contact and maximize one's ability to be a productive hitter. As to the straps 71, the intent for each swing on the device 20 is to contact each piece of hanging material 71 before the baseball 75, the baseball 75, and then each piece of hanging material 71 after the baseball with the sweet spot of the bat. The approximate length of the simulated swing plane on the device is 36 inches. This length seems natural and will continue to be monitored. There is not a resistance factor to the material hanging 71 on the plane P, it is simply a reference point for the plane of the pitch.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the special baseball training device 20 for batting with a level swing called a Swing Plane is not to be limited to only the disclosed embodiment of product. The features of the special devices 20, 21 and 22 are intended to cover various modifications and equivalent arrangements included within the spirit and scope of the description. The present disclosure includes that contained in the appended claims, as well as that of the foregoing description. Although this invention has been described in its preferred form with a certain degrees of particularity, it is understood that the present disclosure of the preferred form has been made only by way of example and that numerous changes in the details of construction and the combination and arrangements of parts may be resorted to without departing from the spirit of the invention.

The invention claimed is:

1. A batter assist trainer device called a Swing Plane made of durable materials with a structural cross-section and comprised of:

(a) a counterbalancing base structure configured with a means for removably connecting to a vertical frame;

(b) the vertical frame comprised of two telescoping pieces and a means for adjusting the length of the vertical frame connecting to a top hanging plane structure;

(c) the hanging frame plane structure comprised of a first side beam member which is further comprised as:

(i) a means for removably connecting both vertically and pivotally to the vertical frame and (ii) a plurality of essentially vertical straps and (d) a second side beam member with a second vertical frame comprised of two telescoping pieces and a means for adjusting the length of the vertical frame connecting to a top hanging plane structure and a second the hanging frame plane structure comprised of at least one beam member which is further comprising:

(i) a means for removably connecting both vertically and pivotally to the vertical frame; and (ii) a plurality of essentially vertical straps wherein the batter may swing a bat at a given plane of swing with a predetermined vertical height and angle to the horizon of a turf or ground on either side of the device or a second batter can use the second side while the batter is using the first side.

2. The device in claim 1 wherein the hanging frame plane structures are further comprised of a pair of baseballs with a means for connecting each to each of the top hanging beam between the vertical hanging straps.

3. The device in claim 1 wherein the counterbalancing base structure is further comprised of a weight and a post for the weight.

* * * * *